428-908.8 SR
12/2/86 XR 4,626,464

United States Patent [19]
Jachowski et al.

[11] Patent Number: 4,626,464
[45] Date of Patent: Dec. 2, 1986

[54] WEAR RESISTANT COMPOUND BODY

[75] Inventors: Johannes Jachowski, Duisburg; Helmut Klasing, Essen; Josef Blum, Essen; Paul Pant, Essen, all of Fed. Rep. of Germany

[73] Assignee: Fried. Krupp Gesellschaft mit beschränkter Haftung, Essen, Fed. Rep. of Germany

[21] Appl. No.: 603,916

[22] Filed: Apr. 25, 1984

[30] Foreign Application Priority Data

Apr. 27, 1983 [DE] Fed. Rep. of Germany ..... 3315125

[51] Int. Cl.[4] ..... B32B 15/04; B22C 9/02

[52] U.S. Cl. ..... 428/212; 428/402; 428/697; 428/698; 428/903.3; 428/908.8; 427/405; 164/349; 51/309

[58] Field of Search ..... 428/212, 402, 697, 698, 428/908.8, 903.3; 427/405

[56] References Cited

U.S. PATENT DOCUMENTS 3,955,038 5/1976 Lindstrom et al. ..... 428/908.8 X
4,346,137 8/1982 Hecht ..... 427/405 X
4,358,923 11/1982 Feldstein ..... 427/405 X
4,369,233 1/1983 van Schaik ..... 427/405 X
4,461,799 7/1984 Gavrilov et al. ..... 428/908.8 X
4,539,251 9/1985 Sugisawa et al. ..... 428/698 X
4,560,615 12/1985 Saito et al. ..... 428/698 X

*Primary Examiner*—P. C. Ives
*Attorney, Agent, or Firm*—Spencer & Frank

[57] ABSTRACT

A wear resistant compound body is disclosed which is comprised of a metallic basic material and has a wear resistant zone which includes hard substance and/or hard metal particles in addition to the basic material. The basic material is composed of
0.001 to 1.5 weight percent carbon,
0.5 to 8 weight percent boron,
1 to 8 weight percent niobium,
0.2 to 6 weight percent chromium,
0 to 30 weight percent nickel,
0 to 10 weight percent manganese,
0 to 6 weight percent vanadium,
0 to 5 weight percent molybdenum,
0 to 5 weight percent silicon, the remainder being iron.

Also disclosed is a casting process for producing the compound body.

8 Claims, 1 Drawing Figure

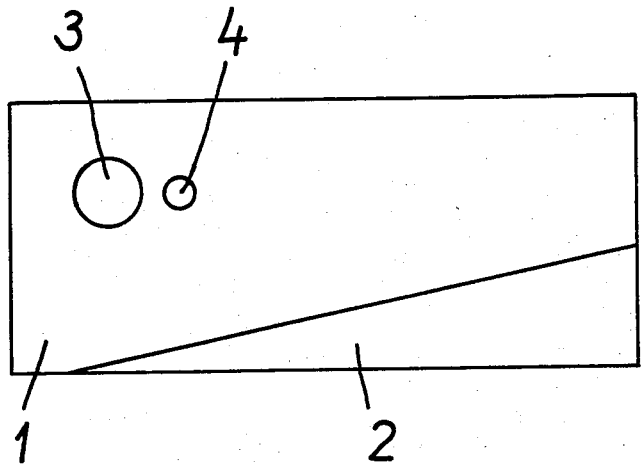
3
4
1
2

WEAR RESISTANT COMPOUND BODY

The present invention relates to a wear resistant compound body comprising a metallic basic material and a wear resistant zone which contains hard substances and/or hard metal particles in addition to the basic material. The present invention further relates to a method for manufacturing such a wear resistant compound body.

BACKGROUND OF THE INVENTION

Compound bodies of the above-mentioned type include parts subject to wear which are armored by welded-on alloys. The welded-on alloys include hard substance or hard metal particles which are enclosed by a welding electrode jacket. When welded onto a metallic substrate, the electrode jacket forms a metal matrix in which the hard substance and hard metal particles are embedded. The metallic substrate and the electrode jacket may be made of the same alloy. The welded-on material forms the wear resistant zone of the part subject to wear. However, the use of welded-on alloys is limited as only thin layers adhere tightly enough to the metal substrate and such thin layers are destroyed relatively quickly.

U.S. Pat. No. 4,365,997 discloses a wear resistant compound body of the above-mentioned type in which the basic material includes 1 to 4 weight percent carbon, 0.3 to 0.6 weight percent silicon, 0.5 to 1.5 weight percent manganese, 0.8 to 2.8 weight percent vanadium, 0.5 to 1.5 weight percent chromium, 2 to 10 weight percent tungsten, 0.01 weight percent aluminum, the remainder being iron, wherein the initial ratio of hard substances and hard metals, respectively, to the basic material is 1:5, with the hard substance and/or hard metal particles having a grain size of from 0.5 to 5 mm. This compound body is produced by adding hard metal and/or hard substance grains, in a size range of from 0.5 to 5 mm, to a liquid metal alloy which has been melted and poured into a mold, whereby the hard metal and hard substance particles descend in the melt before the alloy solidifies. The compound body of U.S. Pat. No. 4,365,997 has the drawback that its basic material is difficult to machine and that, therefore, it is practically impossible to produce a region free of hard substance and/or hard metal from the basic material. Rather, the compound body known from U.S. Pat. No. 4,365,997 must be soldered or welded onto a metallic substrate if it is to be used in a wear resistant workpiece or machine part. An additional drawback of this procedure has been found, as the alloy of which the basic material of the compound body according to U.S. Pat. No. 4,365,997 is comprised is difficult to weld.

SUMMARY OF THE INVENTION

It is the object of the present invention to provide a compound body of the above-mentioned type whose region free of hard metal or hard substances can easily be machined and welded to quickly and reliably connect the compound body with other metal parts.

This means that a basic material must be found which can be machined and welded and which has a sufficiently low melting point to be suitable as a metal matrix for embedding hard substance and/or hard metal particles. It is another object of the present invention to provide a method for producing the compound body.

To achieve these objects and in view of its purpose, the present invention provides an alloy composition suitable for use in a compound body which is easily machined and welded, and which securely embeds hard substance and hard metal particles. Also provided is a method for making the compound body by introducing the hard substance or hard metal particles into the molten alloy while in a mold.

DESCRIPTION OF THE DRAWING

The FIGURE is a cross-sectional view of a compound body according to the invention in the form of a hammer mill beater.

DETAILED DESCRIPTION OF THE INVENTION

We have discovered that the objectives of the invention are achieved using a basic material comprising:

0.001 to 1.5 weight percent carbon,
0.5 to 8 weight percent boron,
1 to 8 weight percent niobium,
0 to 30 weight percent nickel,
0 to 10 weight percent manganese,
0.2 to 6 weight percent chromium,
0 to 6 weight percent vanadium,
0 to 5 weight percent molybdenum,
0 to 5 weight percent silicon, remainder iron;

with hard substance and hard metal particles that have a diameter of from 0.1 to 20 mm, wherein the proportion of hard substance and hard metal particles in the wear resistant zone lies between 25 and 95 volume percent.

We have found that an alloy of the above composition has a low melting point range, below 1400° C., and that this alloy can be machined with surprising ease, is easily welded, and firmly embeds the hard substance and hard metal particles. Therefore, this basic material makes it possible to produce compound bodies having large dimensions which present an easily welded and easily machined metallic region free of hard substances and hard metals and a wear resistant zone containing the hard substances and hard metals, wherein the wear resistant zone is fully integrated.

The compound body according to the present invention has particularly advantageous characteristics and, in particular, is easily welded, if the basic material is composed of:

0.05 to 0.5 weight percent carbon,
0.5 to 2 weight percent boron,
2 to 4 weight percent niobium,
2 to 4 weight percent chromium,
10 to 20 weight percent nickel,
4 to 8 weight percent manganese,
1 to 3 weight percent vanadium,
0 to 2 weight percent molybdenum,
1 to 3 weight percent silicon, the remainder being iron.

According to the present invention, in the preferred embodiment hard substance particles include WC and/or $W_2C$ and the hard metal particles may be comprised of broken-up hard metal scrap. Hard substances in the sense of the present invention are hard carbides, nitrides, borides, and silicides.

Predominantly are used high density carbides like as WC, $W_2C$ and $Mo_2C$ or the above mentioned carbides mixed with other carbides, nitrides, borides and silicides. These hard substances should have a density greater than 7,5 g/cm$^3$. The hardness values are in the range from 1000 to 2000 HV 30. Hard metals in the sense of the present invention are alloys comprising one or a plurality of hard substances, particularly carbides, and a binder metal or alloy comprising iron, cobalt and/or nickel. Hard metal scrap is available as a waste product from the manufacture and use of hard metal products and can be recycled to particular advantage when used in the present invention.

Predominantly are used cobalt bound hard metals for example with the following composition: 4–12 weight % Co, 2–31 weight % TiC+TaC+NbC, remainder WC with hardnesses between 1200 and 1750 HV 30. Hard metals scrap is a waste product in hard metal tool industry. This waste product is broken up and milled to the necessary grain sizes.

Particle sizes out of the range form 0,1 mm to 20 mm are selected in dependance upon the field of application the wear resistant parts are used. But in the most cases particle sizes between 0,5 and 2 mm are used.

According to the present invention it is provided that the proportion of the wear resistant zone in the compound body is between 2 and 50 volume percent. In particular in larger parts that are subject to wear it is advantageous to have only a relatively small portion of the compound body as a wear resistant zone, with the remainder being a metallic region which is free of hard substances and hard metals that can be machined and welded with ease.

The object of the present invention is further achieved by the provision of a process for manufacturing the compound body, wherein a metal melt comprising 0.001 to 1.5 weight percent carbon,
0.5 to 8 weight percent boron,
1 to 8 weight percent niobium,
0.2 to 6 weight percent chromium,
0 to 30 weight percent nickel,
0 to 10 weight percent manganese,
0 to 6 weight percent vanadium,
0 to 5 weight percent molybdenum,
0 to 5 weight percent silicon, the remainder being iron, is poured into a ceramic mold and then hard substance and/or hard metal particles having a diameter of 0.1 to 20 mm are added to the liquid metal melt in such quantities that their percentage in the wear resistant zone lies between 25 and 95 volume percent. This process has the advantage that the metallic region and the wear resistant zone form a single body. Moreover, the hard substance and hard metal particles are firmly embedded in the metal matrix, a process facilitated by the fact that the hard substance particles are completely wet by the melt and the hard metal particles are fused with the melt when they sink into the metal melt and thus are firmly embedded in the metal matrix of the wear resistant zone which forms at the bottom of the mold.

The hard metal particles on their way through the melt to the bottom of the mold are fused on their surface to a depth of approximately 50 micron, so that after the solidification of the casting, in the wear resistant zone there exists a strong compound of the hard metal particles with about 1200 HV 30, the surface layer of the hard metal particles with about 650 HV 30 and the basic material (matrix alloy) between the hard metal particles with about 500 HV 30 hardness.

Hard substance and hard metal particles which have an irregular geometric shape are embedded in the metal matrix with a particularly firm bond. The process according to the present invention can be implemented particularly economically if the mold is comprised of bound mold sand.

According to the present invention, the hard substance and/or hard metal particles may be introduced by being uniformly dispersed on the surface of the metal melt, as above, or the hard substance and/or hard metal particles may be embedded in a plastic carrier that evaporates without residue and introduced into the mold before casting.

As carriers for hard metal particles are used polystyrene beads or polystyrene scrap particles with a diameter between 1 mm and 15 mm. The hard metal particles having a size from 0,1–20 mm and the polystyrene particles are bound with waterglass. The core produced in this way is then dried at about 120° C.

According to both variations of the process, the hard substance and hard metal particles descend to the bottom of the liquid metal melt and there form the wear resistant zone of the compound body. The descent of the hard substance and/or hard metal particles in the metal melt can be influenced in an advantageous manner by vibrating the mold during the introduction of the particles with a suitable commercial device to impart a vibratory movement to the mold.

Finally, the present invention provides that the compound body is used in the production of tools for the mineral, removal and/or comminution of coal, rock, minerals, earth, glass and refuse, since such tools are subjected to particularly extensive wear. Parts made with the present compound body may have different geometric shapes and sizes, and may be attached releasably or firmly to the respective machine tools. For example, the compound body according to the present invention can be processed, according to the present invention, into a weldable dredge tooth, a rock drill, a screw fastened beater for hammer mills or into a baffle plate for an impact pulverizer.

The subject matter of the present invention will now be described in greater detail with the aid of the following embodiment and the accompanying drawing.

EXAMPLE I

In order to produce a beater which is to be installed in a hammer mill and there fastened by means of screws—its dimensions being assumed to be 160×200×500 $mm^3$—an alloy comprising 0.2 weight percent carbon,
1.5 weight percent silicon,
5 weight percent manganese,
2 weight percent chromium,
15 weight percent nickel,
3 weight percent niobium,
1 weight percent boron,
1 weight percent vanadium, the remainder being iron, was poured into a ceramic mold of bound mold sand. Before casting, a core consisting of a mixture of polystyrene particles and hard metal particles, consisting of 12 weight % Co, 2 weight % TiC, remainder WC, having a particle diameter between 0,5 to 2 mm, bound with waterglass and dried at 120° C. was first introduced into the mold. Afterwards the melt was poured at a melting temperature of 1620° C. into the mold.

During the casting process, the plastic carrier evaporated without residue and the hard metal particles descended to the bottom of the 1620° C. metal melt to form a wear resistant zone in the lower portion of the cast compound body. This wear resistant zone occupies about 10 volume percent of the beater and has a hard metal content of about 80 volume percent.

FIG. 1 is a cross-sectional view of the beater comprising the hard metal free, metallic region 1 and the hard metal containing, wear resistant zone 2. After casting, bores 3 and 4 were made in metallic region 1 for fastening the beater to the hammer mill. In its individual regions, the beater has the following hardnesses.

metallic region HV30=240,
wear resistant zone HV30=450 to 550,
hard metal particles in the wear resistant zone HV30=1100.

A beater formed according to the present invention has been found very satisfactory in practice for the comminution of chalky sandstone.

EXAMPLE II

In order to produce a dredge tooth with a weight of 50 kg and a height of 700 mm, where the wear resistant zone in the bottom edge should be filled to a height of 150 mm with hard metal particles, an alloy comprising
0,1 weight percent carbon
1 weight percent silicon
8 weight percent manganese
3 weight percent chromium
10 weight percent nickel
2,5 weight percent niobium
0,5 weight percent boron
1 weight percent molybdenum
1,5 weight percent vanadium the remainder being iron was poured into a ceramic mold of bound mold sand. Before casting, a core consisting of a mixture of polystyrene particles and hard metal particles, consisting of 11,5 weight % Co, 10 weight % TiC+TaC+NbC, remainder WC and having a particle diamater between 0,8 and 1,6 mm, bound with waterglass and dried at 120° C. was first introduced into the mold.

Afterwards the melt with a temperature of 1650° C. was poured into the mold. After solidification of the casting the dredge tooth has in its individual regions the following hardnesses.

(1) metallic region=280 HV 30
(2) wear resistant zone
  (a) hard metal particles=1250 HV 30
  (b) surface layer on the hard metal particles=6-00-800 HV 30
  (c) basic material between the hard metal particles=580 HV 30

The metallic (hard metal-free) region is suitable for welding.

It will be understood that the above description of the present invention is susceptible to various modifications, changes and adaptations, and the same are intended to be comprehended within the meaning and range of equivalents of the appended claims.

What is claimed:

1. A wear resistant compound body comprising a metal alloy basic material and a wear resistant zone containing hard substance and/or hard metal particles in addition to the basic material, wherein said basic material comprises
0.001 to 1.5 weight percent carbon,
0.5 to 8 weight percent boron,
1 to 8 weight percent niobium,
0.2 to 6 weight percent chromium,
0 to 30 weight percent nickel,
0 to 10 weight percent manganese,
0 to 6 weight percent vanadium,
0 to 5 weight percent molybdenum,
0 to 5 weight percent silicon, the remainder being iron; wherein
the hard substance and hard metal particles have a diameter of from 0.1 to 20 mm and the percentage of hard substance and hard metal particles in the wear resistant zone lies between 25 and 95 volume percent; and wherein said hard substance particles are firmly embedded within said metal alloy basic material and said hard metal particles are fused with said metal alloy basic material.

2. The compound body as defined in claim 1, wherein the basic material comprises
0.05 to 0.5 weight percent carbon,
0.5 to 2 weight percent boron,
2 to 4 weight percent niobium,
2 to 4 weight percent chromium,
10 to 20 weight percent nickel,
4 to 8 weight percent manganese,
1 to 3 weight percent vanadium,
0 to 2 weight percent molybdenum,
1 to 3 weight percent silicon, the remainder being iron.

3. The compound body as defined in claim 1, wherein the hard substance particles comprise at least one compound selected from the group consisting of carbides, nitrides, borides, silicides.

4. The compound body as defined in claim 1, wherein the hard substance particles comprise WC and/or $W_2C$.

5. The compound body as defined in claim 1, wherein the hard metal particles comprise alloys comprising one or more hard substances selected from the group consisting of carbides, nitrides, borides, silicides, and a binder metal.

6. The compound body as defined in claim 5, wherein the binder metal is one or more metal selected from the group consisting of iron, cobalt and nickel.

7. The compound body as defined in claim 1, wherein the hard metal particles comprise broken-up hard metal scrap.

8. The compound body as defined in claim 1, wherein the wear resistant zone comprises between 2 and 50 volume percent of the compound body.

* * * * *